US005953881A

United States Patent [19]

Sherry

[11] Patent Number: 5,953,881

[45] Date of Patent: Sep. 21, 1999

[54] ADHESIVE BACKED WINDOW MOLDING AND METHOD OF INSTALLING THE SAME

[76] Inventor: Howard W. Sherry, 111 Webster Ave., Stratford, N.J. 08084

[21] Appl. No.: 09/002,817

[22] Filed: Jan. 5, 1998

Related U.S. Application Data

[62] Division of application No. 08/684,825, Jul. 22, 1996, Pat. No. 5,705,002.

[51] Int. Cl.[6] ..... E04F 19/02

[52] U.S. Cl. ..... 52/746.1; 52/287.1; 52/717.01; 52/717.04; 52/717.05; 52/745.15

[58] Field of Search ..... 52/287.1, 717.01, 52/717.04, 717.05, 745.15, 746.1

[56] References Cited

U.S. PATENT DOCUMENTS

| | | | |
|---|---|---|---|
| 2,862,264 | 12/1958 | Perna | 52/287.1 |
| 3,408,250 | 10/1968 | Finefrock | 52/287.1 X |
| 4,064,995 | 12/1977 | Bustos | 52/287.1 X |

*Primary Examiner*—Christopher T. Kent
*Attorney, Agent, or Firm*—Norman E. Lehrer

[57] ABSTRACT

A molding is designed to be secured in a corner between intersecting planar members such as between a wall and a window. The molding comprises an elongated angled member with first and second side walls. Each of the side walls has front and rear surfaces with double faced adhesive strips secured to the rear surfaces of the side walls. Release backings cover said adhesive strips. The molding is installed by first pulling an upper section of the release backings downwardly to expose a portion of adhesive strip. The release backings are then manipulated so that they extend outwardly from the walls. Thereafter, the molding is placed in the corner with the side walls overlying the planar members so that the exposed portions of the adhesive strips contact the planar members. Finally, the upper sections of the release backings are pulled downwardly to fully expose the adhesive strips while the side walls are pressed against the planar members so that each of the adhesive strips firmly contacts and engages its respective planar member.

4 Claims, 2 Drawing Sheets

ADHESIVE BACKED WINDOW MOLDING AND METHOD OF INSTALLING THE SAME

This application is a division of application Ser. No. 08/684,825 filed Jul. 22, 1996, now U.S. Pat. No. 5,705,002.

BACKGROUND OF THE INVENTION

The present invention relates to molding that is secured between an opening formed in a wall and a window and, more particularly, to such molding that includes an angled member, with adhesive secured to two sides thereof, and two elongated flat members which are each adapted to be secured to and extend from the angled member. The invention also relates to a method of securing the molding between the wall and the window.

Plastic moldings are commonly secured between a wall opening and a window. The molding fills any space which exists between the wall and the window. A problem with most existing moldings is that they are relatively difficult to install. For example, some known moldings are tacked to the wall and the window. This requires a plurality of individual tacks to be hammered along height of the molding. Other moldings are glued to the wall and the window. Gluing the molding requires that careful and meticulous attention be paid in order to avoid getting glue on the exposed portion of the molding as well as on the wall and the window.

Some moldings are equipped with tape or other adhesive means to secure the molding to the desired area. See, for example, U.S. Pat. Nos. 3,408,250 and 4,614,347. However, these moldings are not designed to be secured to and between a wall and a window. Furthermore, these moldings do not include a means for easily gripping the paper backing that covers the adhesive so that the backing can be readily removed while the molding is positioned in a desired location.

SUMMARY OF THE INVENTION

The present invention is designed to overcome the deficiencies of the prior art discussed above. It is an object of this invention to provide molding that can be firmly secured between an opening in a wall and a window.

It is another object of the invention to provide such molding that is aesthetically pleasing.

It is a still further object of the invention to provide a method for installing molding between a wall opening and a window.

In accordance with the illustrative embodiments, demonstrating features and advantages of the present invention, there is provided molding which is designed to be secured between a wall and a window. The molding comprises an elongated angled member with first and second side walls. Each of the side walls has front and rear surfaces and a groove formed therein. A double faced adhesive strip is secured to the rear surface of one of the side walls. A pair of substantially flat members are provided. Each of the flat members is adapted to be partially friction fit in a corresponding one of the grooves in the side walls of the angled member. Each of the flat members has an adhesive strip secured to the rear surface thereof in order to allow one of the flat members to be secured to the window and the other flat member to be secured to the wall.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 4:
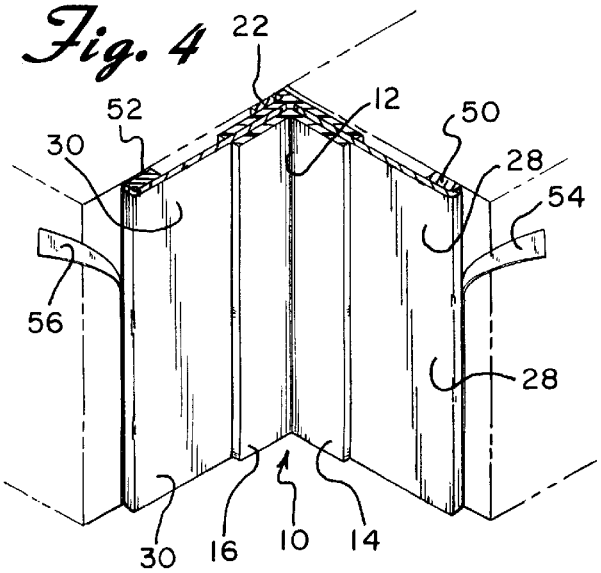
FIG. 4 is a front perspective view of the present invention.

Referring now to the drawings in detail wherein like reference numerals have been used throughout the various figures to designate like elements, there is shown in FIG. 4 an adhesive backed window molding constructed in accordance with the principles of the present invention and designated generally as 10.

Figure 1:
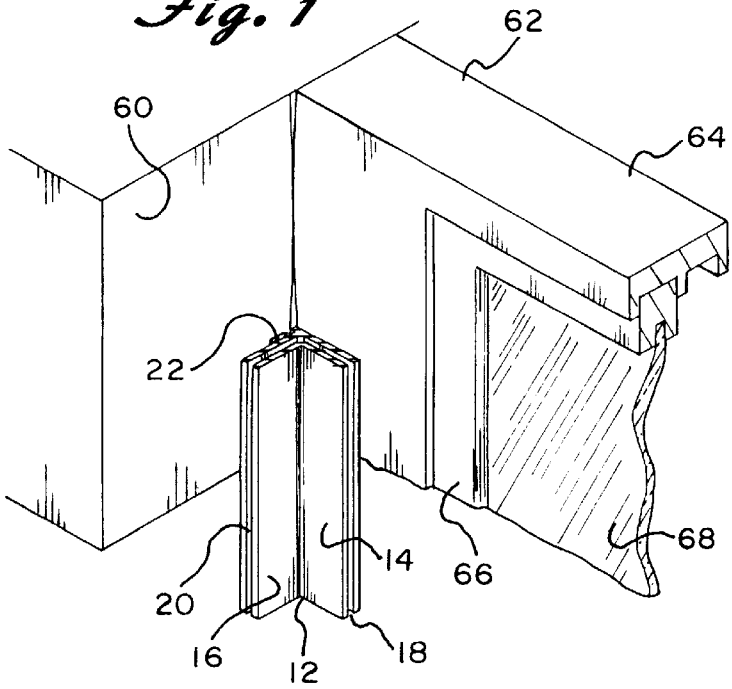
FIG. 1 is a partial front perspective view of the angled member of the present invention shown spaced from the intersection of a wall and a window.
Figure 2:
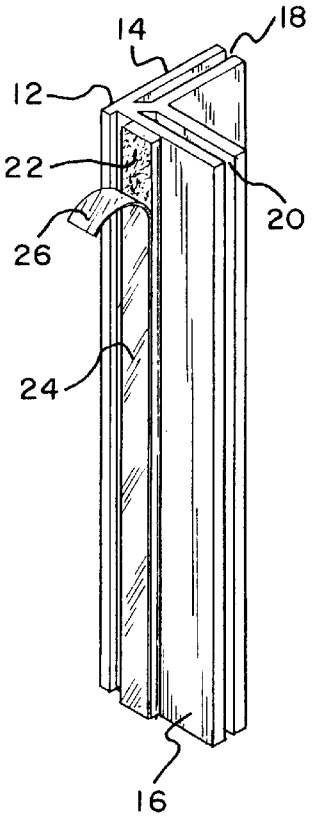
FIG. 2 is a rear perspective view of the angled member.

The molding 10 includes an elongated angled member 12 preferably comprised of extruded vinyl. However, the angled member can be made in a number of other ways such as by molding and can be comprised of other materials. The angled member 12 includes a first side wall 14 and a second side wall 16. Side wall 14 has a groove 18 formed therein as best illustrated in FIGS. 1 and 2. Similarly, side wall 16 has a groove 20 formed therein. Each of the side walls has a front surface and a rear surface. Side wall 14 is approximately ⅝" wide and side wall 16 is approximately 9/16" wide. The height of the side walls preferably corresponds to the height of the window being installed.

A pressure sensitive adhesive strip 22 is secured to the rear surface of side wall 16. The strip 22 has front, rear and opposing sides. The front and rear sides of the strip 22 are covered with adhesive. When securing the strip 22 to the rear surface of the side wall 16, the rear side of the strip is adhesively secured to the side wall along substantially the entire height thereof. The strip 22 is preferably about ¼" wide and has a thickness of about 1/16". The height of the strip corresponds to the height of the angled member.

Figure 3:
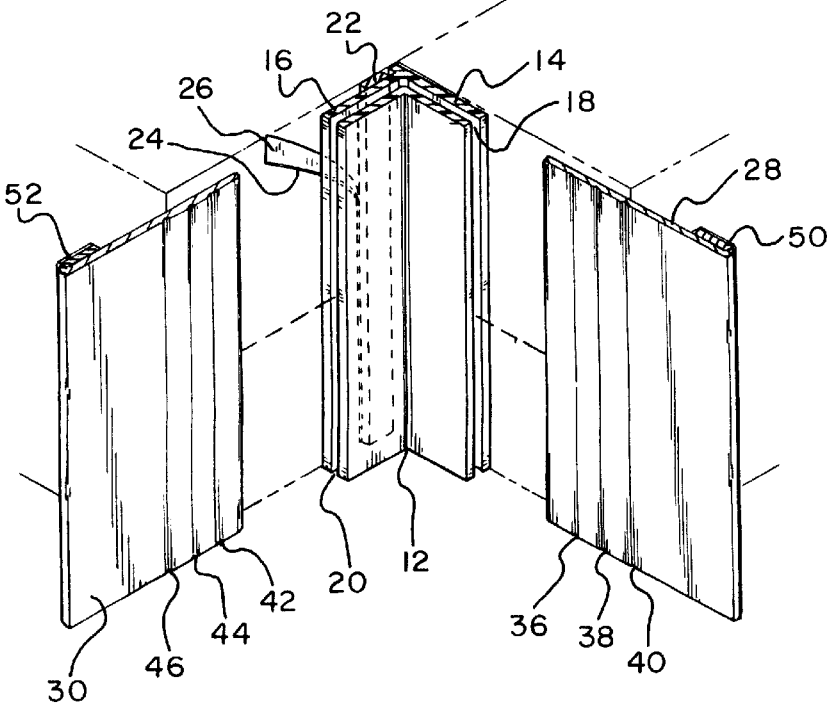
FIG. 3 is an exploded front perspective view of the present invention.

In the preferred embodiment, the adhesive strip 22 is covered with a protective release backing 24 (FIGS. 2 and 3). The backing preferably has a section 26 that extends up passed the top of the adhesive strip 22. The upper section provides a means for readily gripping the backing and pulling it downward as the member 12 is being installed as more fully described below. The backing is preferably comprised of polyethylene. However, it can be comprised of other material such as paper.

Referring to FIGS. 3 and 4, the adhesive backed window molding 10 includes two substantially flat members 28 and 30. Each of the flat members has one end which is adapted to be frictionally fit in a corresponding one of the grooves 18, 20 formed in the angled member 12. Flat member 28 preferably has a plurality of score lines 36, 38 and 40 formed along the entire height thereof. Similarly, flat member 30 has a plurality of score lines 42, 44, and 46 formed along the entire height thereof. The score lines allow the width of the flat members to be adjusted. For example, if one desires to reduce the width of the flat members, he or she simply removes part of the flat member by tearing or severing the same along an appropriate one of the score lines.

Secured to the rear surface of the flat member 28 adjacent the end opposite the score lines is a pressure sensitive adhesive strip 50. The strip 50 is preferably secured along substantially the entire height of the flat member 28. A similar strip 52 is also preferably secured along substantially the entire height of the flat member 30.

In the preferred embodiment, each of the adhesive strips 50 and 52 is covered with a protective release backing 54 and 56. (FIG. 4). Each of the backings preferably has a section which extends up passed the top of the corresponding adhesive strip to which it is attached. As stated above, the upper section provides a means for readily gripping the backing and pulling it downward as the window molding 10 is being installed.

In order to facilitate an understanding of the principles associated with the foregoing apparatus, its operation will now be briefly described. The angled member 12 and each of the flat members 28 and 30 are cut to a desired height. The upper section 26 of the release backing 24 is pulled downward to expose part of the adhesive strip 22 (FIG. 3). Thereafter, the upper section 26 is manipulated so that it extends outwardly from the side wall 16 of the angled member 12.

The angled member 12 is then positioned in the corner formed between wall 60 and window 62 to cover any gaps created during the installation of the window in the opening formed in the wall (FIG. 1). The window includes a window frame 64, a sash 66, and a pane of glass 68. The angled member 12 is positioned in the corner so that the exposed upper portion of the adhesive strip 16 contacts and adheres to the wall 60.

In the preferred method, the exposed portion of the adhesive strip is wetted to prevent the same from sticking to the wall in undesired locations during the installation of the angled member. The exposed portion of the strip is then allowed to dry. Thereafter, the upper section 26 of the backing 24 is pulled out and downward to expose the rest of the adhesive strip 16 while the angled member 12 is manually forced into the corner. As the adhesive strip is exposed, it is simultaneously secured in place by pressing the adhesive strip against the wall 60. It should be noted that an adhesive strip could be positioned on the side wall 14 in order for the angled member to be adhesively secured to the window 62.

Once the angled member 12 is secured in place, the upper section of release backing 54 is pulled downward to expose part of the adhesive strip 50 (FIG. 4) positioned on the rear surface of flat member 28. The upper section of release backing 56 is similarly pulled downward to expose part of the adhesive strip 52 positioned on the rear surface of flat member 30. The ends of each of the flat members 28 and 30 are then friction fit in a corresponding one of the grooves 18 and 20 formed in the side walls 14 and 16 of the angled member 12. The exposed portions of the adhesive strips 50 and 52 are placed in contact with the window 62 and the wall 60, respectively.

The exposed portions of the adhesive strips 50 and 52 are preferably wetted to prevent the same from sticking to the wall and window in undesired locations. The exposed portions of the strips are then allowed to dry. Thereafter, the upper sections of the backings 54 and 56 are pulled outwardly and downwardly to expose the rest of the adhesive strips 50 and 52 while the flat members are manually forced against the wall or window. As the adhesive strips are exposed, they are simultaneously secured in place by pressing the adhesive strips against the wall 60 and the window 62.

Figure 6:
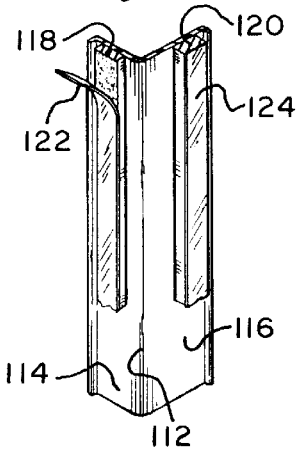
FIG. 6 is a rear perspective view of an angled member of the alternate embodiment.
Figure 7:
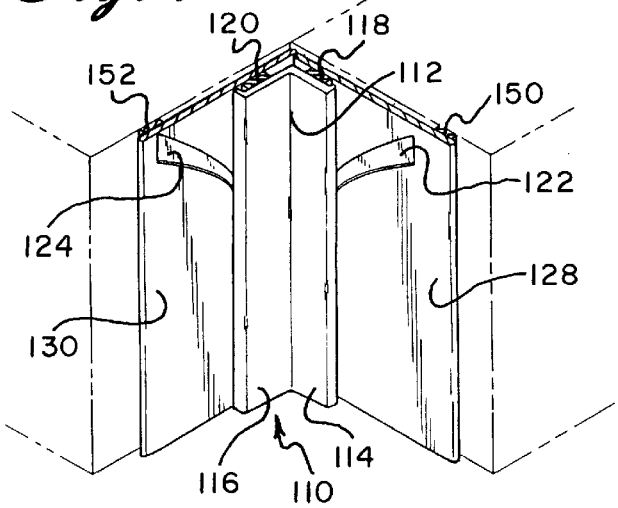
FIG. 7 is a front perspective view of the alternate embodiment.

Referring to FIG. 7, an alternate window molding 110 is shown. The window molding 110 comprises an angled member 112 which includes side walls 114 and 116. Pressure sensitive adhesive strips 118 and 120 are each secured to a corresponding rear surface of one of the side walls 114 and 116 (FIG. 6). Each of the strips has an adhesive front side which is covered with a protective release backing 122 and 124.

Figure 5:
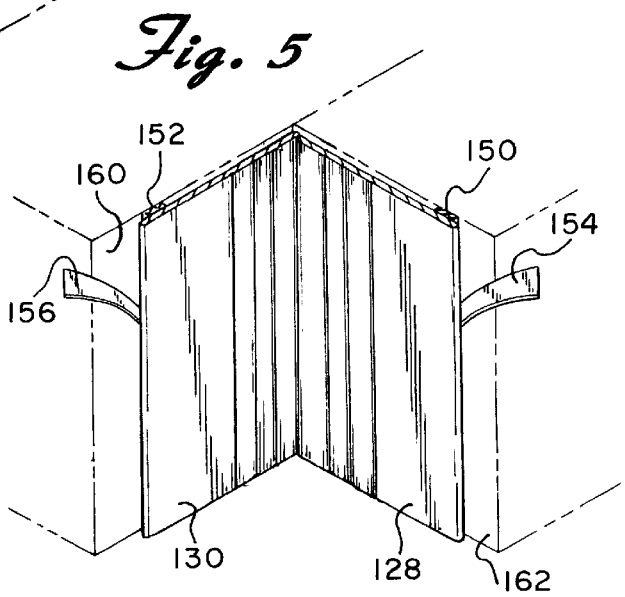
FIG. 5 is a front view perspective view of an alternate embodiment showing two flat members adhesively secured between a wall and a window.

The adhesive backed window molding 110 includes two substantially flat planar members 128 and 130 (FIGS. 5 and 7). Each of the flat members could have a plurality of score lines formed therein in order to allow the length of the same to be readily adjusted in the manner described above. Secured to the rear surface of the flat member 128 adjacent one end thereof is a pressure sensitive adhesive strip 150. The strip 150 is preferably secured along substantially the entire height of the flat member 128. A similar strip 152 is also preferably secured along substantially the entire height of the flat member 130.

Each of the adhesive strips 150 and 152 is covered with a protective release backing 154 and 156, respectively (FIG. 5). Each of the backings preferably has a section which extends up passed the top of the corresponding adhesive strip to which it is attached. As stated above, the upper section provides a means for readily gripping the backing and pulling it downward.

The adhesive backed window molding is installed in the following manner. The angled member 112 and each of the flat members 128 and 130 are cut to a desired height. The upper sections of the release backings 154 and 156 are pulled downward to expose part of the adhesive strips 150 and 152 secured to the rear surface of flat members 150 and 152 (FIG. 5). Thereafter, the upper sections of the release backings 154, 156 are manipulated so that they each extend outwardly from the ends of their associated flat members 128 and 130. Flat member 128 is then positioned adjacent a window 162 and flat member 130 is positioned adjacent a wall 160. Thereafter, the upper sections of the backings 154, 156 are pulled outwardly and downwardly to expose the rest of the respective adhesive strips 150, 152 while the flat members are manually forced against the wall or window. As the adhesive strips are exposed, they are simultaneously secured in place by pressing the adhesive strips against the wall and the window. As can best be seen in FIGS. 5 and 7, the members 128 and 130 essentially intersect to form a comer into which the angled member 112 is then to be installed.

Once the flat members are secured in place, the upper sections of the release backings 122, 124 on the angled member 112 are pulled downward to expose part of the adhesive strips 118 and 120 (FIG. 6). The angled member 112 is then positioned in the corner formed between the two flat members 128 and 130 so that each of the exposed portions of the adhesive strips 118 and 120 are placed in contact with a corresponding one of the flat members.

The exposed portions of the adhesive strips 118 and 120 are preferably wetted to prevent the same from sticking to the wall and window in undesired locations. The exposed portions of the strips are then allowed to dry. Thereafter, the upper sections of the backings 122 and 124 are pulled outwardly and downwardly to expose the rest of the adhesive strips 118 and 120. As the adhesive strips are exposed, they are simultaneously secured in place by pressing the adhesive strips against the respective flat members.

The present invention may be embodied in other specific forms without departing from the spirit or essential attributes thereof and accordingly reference should be made to the appended claims rather than to the foregoing specification as indicating the scope of the invention.

What is claimed is:

1. A method of installing an adhesive backed window molding including an elongated angled member with two side walls, a pair of substantially flat members, a pair of adhesive strips, a pair of release backings, each of said adhesive strips secured to a corresponding one of said flat members, each of said release backings covering a corresponding one of said adhesive strips, said method comprising the steps of:

pulling an upper section of each of said release backings on said flat members downwardly to expose a portion of said adhesive strip;

manipulating said upper sections of said release backings so that they each extend outwardly from a corresponding one of said flat members;

placing one of said flat members against said window so that said exposed portion of said corresponding adhesive strip contacts said window and placing the other of said flat members against said wall so that said exposed portion of said corresponding adhesive strip contacts the wall and both of said flat members form a corner;

further pulling said upper sections of said release backings downwardly to fully expose said adhesive strips so that each of said adhesive strips firmly contacts and engages said wall and said window, respectively, securing said angled member in said corner formed by said flat members.

2. The method of claim 1 further including the steps of:

wetting said exposed portions of said adhesive strips before placing said flat members against said wall and said window, and allowing said exposed portions of said adhesive strips to dry while simultaneously pressing said exposed portions of said adhesive strips against said wall and said window.

3. A method of installing an adhesive backed molding in a comer formed by intersecting first and second planar members which molding includes an elongated angled member with first and second side walls, a pair of adhesive strips and a pair of release backings, each of said adhesive strips being secured to a corresponding one of said walls and each of said release backings covering a corresponding one of said adhesive strips, said method comprising the steps of:

pulling an upper section of each of said release backings on each of said walls downwardly to expose a portion of said adhesive strip;

manipulating said upper sections of said release backings so that they each extend outwardly from a corresponding one of said walls;

placing said molding in said comer with said first and second walls overlying said first and second planar members so that said exposed portions of said corresponding adhesive strips contact said planar members;

further pulling said upper sections of said release backings downwardly to fully expose said adhesive strips while pressing said first and second walls against said first and second planar members so that each of said adhesive strips firmly contacts and engages its respective first and second planar member.

4. The method of claim 3 further including the steps of:

wetting said exposed portions of said adhesive strips before placing said molding in said corner, and allowing said exposed portions of said adhesive strips to dry while simultaneously pressing said exposed portions of said adhesive strips against said first and second planar members.

* * * * *